United States Patent [19]

Hiering et al.

[11] Patent Number: 5,034,658

[45] Date of Patent: Jul. 23, 1991

[54] CHRISTMAS-TREE, DECORATIVE, ARTISTIC AND ORNAMENTAL OBJECT ILLUMINATION APPARATUS

[76] Inventors: Roland Hiering, Berliner Strasse 60, D-8000 Munchen 40; Vladimir Ilberg, Untersbergstr. 74, D-8000 Munchen 90, both of Fed. Rep. of Germany

[21] Appl. No.: 464,150

[22] Filed: Jan. 12, 1990

[51] Int. Cl.[5] ..... H01K 7/00

[52] U.S. Cl. ..... 315/76; 315/149; 315/248; 362/123; 362/810

[58] Field of Search ..... 315/76, 149, 248, 363; 362/123, 227, 249, 252, 800, 806, 810

[56] References Cited

FOREIGN PATENT DOCUMENTS 3642890 7/1989 Fed. Rep. of Germany ..... 362/123

*Primary Examiner*—Robert J. Pascal

*Attorney, Agent, or Firm*—Antonelli, Terry, Stout & Kraus

[57] ABSTRACT

An illuminating system is provided for objects such as Christmas trees, decorations, works of art and ornaments. Electrically operated, light-emitting elements are hung on or fastened to or within these objects. The light-emitting elements include an electrical oscillatory circuit which can include, for example, inductive and capacitive elements. An energy source powers the elements with direct connection by way of electromagnetic waves or infrared light. The energy source can take the form of, for example, a high-frequency transmitter or an infrared radiation source.

22 Claims, 3 Drawing Sheets

CHRISTMAS-TREE, DECORATIVE, ARTISTIC AND ORNAMENTAL OBJECT ILLUMINATION APPARATUS

BACKGROUND OF THE INVENTION

The present invention relates to an illumination apparatus for Christmas trees, decorations, works of art, and ornaments with electrical, light-emitting elements and, more particularly, to illumination devices which are hung or fastened on the aforementioned objects or are built into these objects and supplied with necessary operating energy or electrical power.

In Christmas-tree, decorative, and artistic illumination devices of this general kind, a sufficient power supply is required to achieve a desirable brightness in the electrical incandescent bulbs which are most frequently employed. The incandescent lamps are connected by electrical conductors or cables either to the socket and the full line voltage, or to a low voltage through a transformer, a storage battery, or a dry battery.

In conventional Christmas-tree and decorative illuminations, it is necessary for all the incandescent bulbs to be connected together by electrical conductors which in turn, are connected by means of a double wire or cable to the 220-volt or 110-volt AC, 50 Hz or 60 Hz socket, or to a lower voltage, at the secondary of a transformer.

Under these conditions, the incandescent bulbs are wired in series when they are connected to the full 220- or 110-volt alternating current, and are connected in parallel when they are connected to a lower voltage, e.g. 12 volts. When works of art are illuminated externally or internally, the same power supply arrangement is required.

The absolutely necessary electrical connection of the individual incandescent bulbs to one another and also to the line socket with electrical conductors, insulated wires, double wires, or cables poses several disadvantages and problems.

The distribution and mounting of incandescent bulbs on Christmas-tree branches is limited and/or complicated by the connecting wires.

When connected in series to the 220- or 110-volt line voltage and one of the incandescent bulbs burns out, the circuit to all the incandescent bulbs is broken, unless each of the individual bulbs is provided with a special bridging fuse. The circuit is restored only when the defective incandescent bulb is replaced with a new one.

When the lights are connected to a line voltage of 220 or 110 volts, especially good electrical insulation of the conducting wires is required for safety reasons. When the incandescent bulbs are connected in parallel, they must be connected together by two conductors or a double wire. The double wire and electrical conductors must also exhibit good electrical insulation in order to prevent a short circuit, especially in damp conditions.

Conventional Christmas-tree and artistic illumination devices using connecting wires and/or connecting cables do not have an aesthetic appearance and are very difficult to mount in the desired locations.

Unpacking and putting away Christmas-tree lights in particular pose considerable disadvantages as a result of the continuous tangling of the electrical conductors, wires, double wires, and cables.

SUMMARY OF THE INVENTION

A main object of the present invention is to eliminate the aforementioned disadvantages of conventional Christmas-tree, decorative, and artistic lighting systems.

This object is achieved in accordance with the present invention by providing at least one or more light-emitting elements composed of at least one energy source which transmits electromagnetic waves or infrared light with zero contact i.e., without an electrical connection to the new Christmas-tree, decorative, artistic, and ornamental lighting system.

The light-emitting elements are connected according to the present invention directly to an electrical oscillatory inductive/capacitive circuit, for example, a circuit with a coil and a capacitor. This has the further advantage that the coil can be provided with a low-loss, high-frequency ferrite core or a good conductor.

The light-emitting elements are advantageously formed according to the present invention from light-emitting diodes (LEDs) which emit light of different colors and require only a low voltage (for example, 1.5 to 4 volts) and a low current (for example, 2 to 20 milliamperes).

According to an embodiment of the present invention, at least two LEDs can be connected to the oscillatory circuit in an antiparallel connection. The light-emitting elements can also be made of electroluminescent lights (EL), vacuum fluorescent elements (VFE), or plasma lights, but can also consist of neon bulbs and incandescent bulbs.

According to one embodiment of the present invention, the light-emitting elements together with the oscillatory circuit are made in the shape of a candle, especially for Christmas-tree and decorative illumination.

Alternatively, the light-emitting elements with the oscillatory circuit can be incorporated into glass balls, objects made of glass or other decorative shapes.

In accordance with other embodiments of the present invention, the light-emitting elements can be installed for external or internal illumination in ornamental works of art made of glass, plastic, precious stones, precious metals, or other materials. It is also within the scope of the present invention to incorporate the light-emitting elements together with the oscillatory circuit into toys, objects of everyday use, textiles, or other objects made of materials of all kinds.

The inductance portion of the oscillatory circuit constructed in accordance with the principles of the present invention can advantageously be made in the form of large loops or in different shapes as suspended ornaments as, for example, a circle, square, polygon, star, letter of the alphabets, number, or another artistic shape.

The light-emitting elements can also be connected within the scope of the present invention to a solar cell panel which supplies a sufficient voltage (for example, 3 volts) and a sufficient current (for example, 10 milliamperes) for powering the elements.

The energy source for the Christmas-tree, decorative, artistic, and ornamental illumination according to the present invention advantageously consists of a high-frequency transmitter which delivers a constant frequency (for example, 27 MHz) at a sufficient power (for example, 2 watts) continuously or in pulses.

The power source of the Christmas-tree, decorative, artistic, and ornamental illumination according to the present invention also consists of an infrared radiation source, a laser, or a group of light-emitting diodes connected in parallel and in series, so as to radiate the infrared light continuously, in pulses, or in a modulated mode. This is particularly advantageous when the light-emitting elements according to the invention are connected directly to solar cell panels. The power sources can be supplied either from the line voltage, a storage battery, a dry battery, solar cells, or other forms of energy.

The antenna of the high-frequency transmitter of the Christmas-tree, decorative, artistic, and ornamental illumination can be made according to the invention in the form of a rod, dipole, or loop. At higher radiated power levels, the antenna can be coated with insulating material for a high-frequency voltage protection.

In order to achieve low losses in this wireless energy supply to the light-emitting elements on the Christmas-tree, decorative, artistic, and ornamental illumination devices, the coils of the oscillatory circuit as well as the antenna can in accordance with the present invention be made of a material which operates as a superconductor with a resistance nearly equal to zero at a temperature which is not much lower than room temperature.

In order for the oscillatory circuit together with its connected light-emitting elements to be supplied additionally and more effectively with high-frequency energy from the auxiliary oscillatory circuit which has a high Q factor, at least one of the oscillatory circuits whose resonance is tuned to the frequency of the high-frequency transmitter, together with the connected light-emitting elements, can be located in accordance with the present invention in the vicinity of, or directly in the confines of, at least one large loop of an auxiliary oscillatory circuit tuned to the same resonance.

The aforementioned embodiments provide a number of advantages. For example, the power supply to the light-emitting elements is provided without electrical connection from the energy source. This eliminates problems with wires and cables which cause a great deal of difficulty in conventional Christmas-tree, decorative, artistic, and ornamental illumination arrangements. When the light-emitting elements, especially those in the shape of candles, are mounted on the Christmas tree, and when the lights are either being unpacked and packed away, there is no need to be concerned about the connecting wires and/or double wires or cables.

Furthermore, burn out of one of the light-emitting elements should not have any disturbing effects on the other light-emitting elements. There is also no possibility of short circuit problems, since the connecting double wires and cables are eliminated. The aesthetic appearance both during illumination of the Christmas tree and during external or internal illumination of works of art made of glass and other transparent materials or plastics is no longer detracted from by the power supply connecting wires.

The light-emitting elements can simply be built into or held onto these works of art, fastened to them, or connected together, creating attractive colored lighting effects.

The light-emitting elements and the oscillatory circuit can be miniaturized, especially when using light-emitting diodes (LEDs), and thereby become much more suitable for installation, mounting, illumination, and internal illumination of jewelry and precious stones, than would conventional light sources. In such case, the aesthetic effect is also not adversely affected; on the contrary, a new light-radiating effect of jewelry and precious stones is achieved which heightens even further the aesthetic effect of the object in question.

The coil of the oscillatory circuit and the antenna can be made of a material which operates as a superconductor at a temperature which is not much lower than room temperature, so that a high degree of efficiency of the wireless power supply from the energy source is achieved. The much lower resistance of the superconductor produces a high Q factor in the coils of the oscillatory circuit and antenna, so that very low losses occur as a result.

BRIEF DESCRIPTION OF THE DRAWINGS

These and other features, objects and advantages of the present invention will become more apparent from the following description of several presented preferred embodiments when taken in conjunction with the accompanying drawings wherein:

FIG. 1 shows a Christmas-tree lighting system;

DETAILED DESCRIPTION OF PREFERRED EMBODIMENT

Figure 1A:
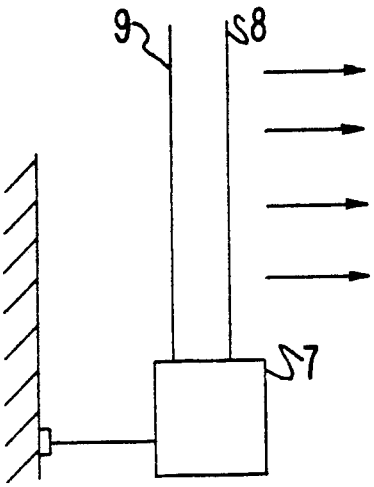
FIG. 1*a* is a schematic diagram of the system shown in FIG. 1.
Figure 1B:
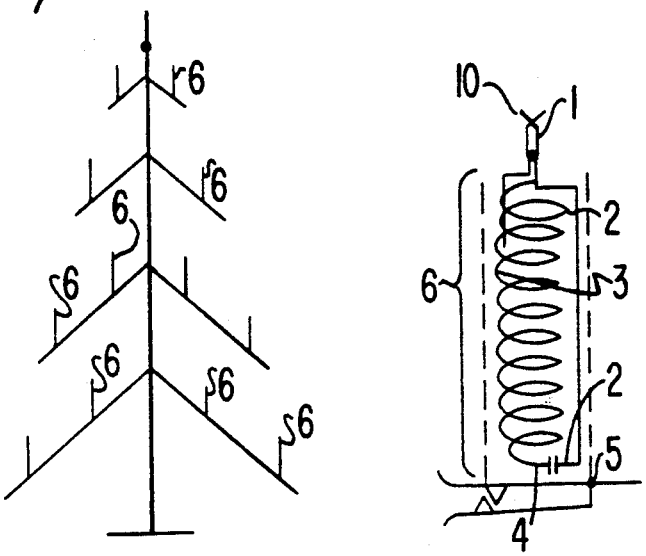
FIG. 1*b* is a schematic view of an LED with an oscillatory circuit used as an electric candle in the system of FIG. 1.

Referring now to the drawings and, in particular to FIG. 1, a Christmas-tree lighting system is shown schematically, in which light-emitting diodes (LEDs) 1 shown in FIG. 1*b* radiate light of different colors. Each of the LEDs 1 has an LC oscillatory circuit 2 tuned to the resonant frequency of 27 MHz, an air-core coil 3 and a trimmer capacitor 4 in a holder 5 to form the shape of an electric candle 6. A high-frequency transmitter 7 shown in FIG. 1*a* serves as a zero-contact power supply. The high-frequency transmitter 7 radiates electromagnetic energy at a power of 20 watts from a quarter-wave rod antenna 8 in the direction of the Christmas tree, which is typically about 0.5 to 5 m away from the antenna. Antenna 8 can be provided with a reflector 9 to direct the electromagnetic radiation in the desired direction. The LEDs are provided with a shield 10 made of glass or transparent plastic which is also silvered on the bottom in order to direct the rays of light more to the side and downward. Instead of LEDs, as previously noted, the light-emitting elements can be electroluminescent lights, vacuum fluorescent elements, plasma light, neon bulbs or incandescent bulbs.

Figure 2A:
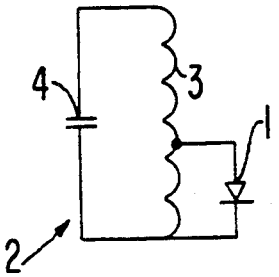
FIG. 2*a* is a schematic view of an oscillatory LC circuit with one LED at the tap on the coil used in the present invention.
Figure 2B:
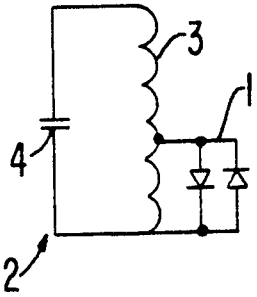
FIG. 2*b* is a schematic view similar to the circuit of FIG. 2*a* but using two LEDs connected anti-parallel.

FIG. 2*a* is an electrical schematic of LC oscillatory circuit 2 of FIG. 1*b* with one LED 1 tapped off coil 3 to create an optimum power adjustment for transmission of electrical energy from the oscillatory circuit to the LEDs, whereas FIG. 2*b* shows the circuit with two LEDs 1 connected antiparallel and advantageously using both half-waves of the high-frequency signal for their power source.

Figure 2C:
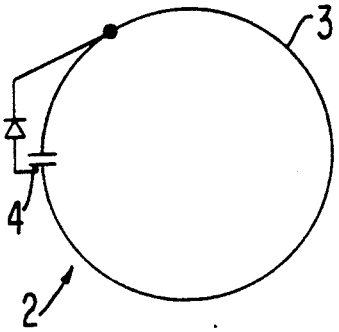
FIG. 2*c* is a schematic view of an electrical circuit using a large L-shaped loop for hanging.

FIG. 2*c* shows an LC oscillatory circuit 2 with a large coil loop 3 which forms a sufficient inductance and can be used advantageously for hanging. As a result of the large loop area of the coil with a few turns or with only one turn, a good energy supply is provided to the LEDs.

Figure 3:
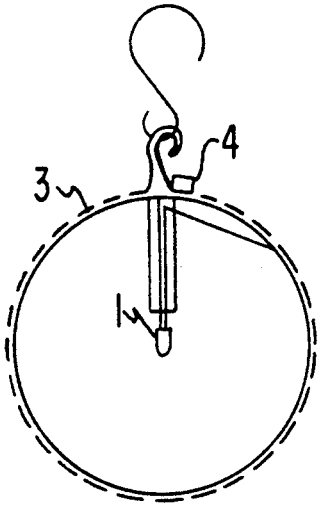
FIG. 3 shows the use of a circuit similar to FIG. 2*c* in a glass ball on a Christmas tree or as a decoration.

FIG. 3 shows a glass ball at least 6 to 10 cm in diameter for use on Christmas trees or as a decoration, in which two to five turns (depending on the size of the ball) of a good electrical conductor are wrapped around the surface to form coil 3, or the turns are made directly on the surface. In either case, the turns form an LC oscillatory circuit 2 with a chip or trimmer capacitor 4 which is tuned to the resonant frequency of 27 MHz, whereby at the tap of coil 3 one or two LEDs 1 are connected in an antiparallel circuit and are mounted inside the glass ball to illuminate it from inside.

Figure 4:
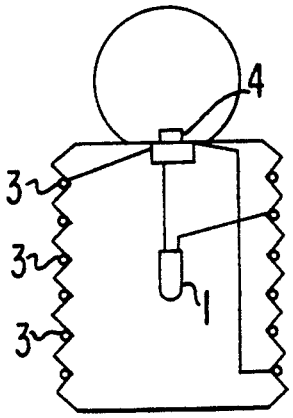
FIG. 4 shows the use of a circuit similar to FIG. 2*c* in a Chinese lantern for decorative purposes.

FIG. 4 shows a Chinese lantern for decorative purposes, in which the turns of coil 3 are wound around the cylinder of the lantern and are tuned with a trimmer capacitor 4 to the resonant frequency of 27 MHz. The capacitor 4 is mounted on the upper part of the lantern and forms an LC oscillatory circuit 2, with one or two LEDs 1 used as light-emitting elements being connected to the tap of coil 3 and mounted inside the lantern to illuminate it from within. However, fluorescent elements (VFE) or plasma elements can also be used without departing from the scope of the present invention by being connected to the complete turn of coil 3 and used for illumination from within.

Figure 5:
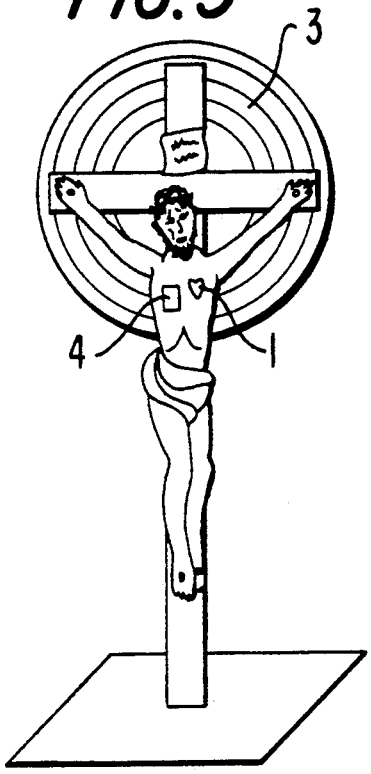
FIG. 5 shows a work of religious art representing in this example the figure of Christ on the cross, with an illuminated heart.

FIG. 5 shows an example of a work of religious art in which the Christ figure on the cross is shown with a light-emitting heart as a symbol of love embodying the inventive concept disclosed herein. The light is emitted by an LED 1 and is connected to the tap of a coil with a plurality of turns 3 which are shaped aesthetically as spiral-shaped loops forming a halo around the head of Christ and then tuned with a hidden trimmer capacitor 4 to the resonant frequency of 27 MHz to form an LC oscillatory circuit. The heart can be made symbolically from a polished precious stone or can be made of glass or another transparent material through which the light from the built-in LED shines. Likewise, two LEDs 1 in an antiparallel circuit of the type shown in FIG. 2*b* can be used for illumination from within.

Figure 6:
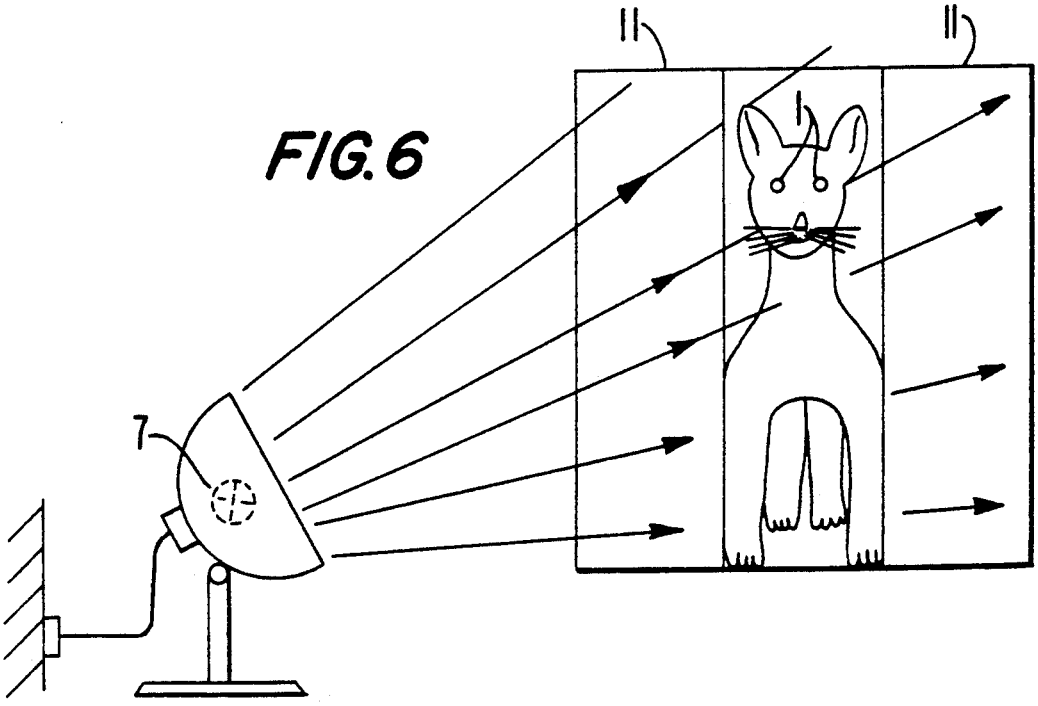
FIG. 6 shows a work of art representing a cat with luminous eyes.

FIG. 6 shows another work of art that represents a black cat with shining green eyes. The light comes from two green LEDs constituting the cat's eyes which are made of green glass or precious stones and are illuminated from within with the LEDs being connected directly to a 3 volt solar cell panel 11 of conventional construction which is irradiated with infrared light from an energy source 7 and delivers a current of 20 milliamperes. Energy source 7 in the example comprises an infrared bulb with a power greater than 200 watts and radiates from a distance of less than 3 m in the direction of the solar cell panel 11. Alternatively, the source 7 could be a laser or a group of LEDs connected in parallel or in series, which modulate the infrared light continuously, in pulses, or in modulated form. Instead of a cat, it is also possible to use the present invention in, for example, a white rabbit with shining red eyes.

Figure 7:
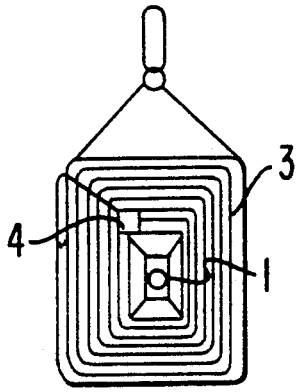
FIG. 7 shows jewelry in the form of pendant earrings with illuminated precious stones.

FIG. 7 shows an ornament in the form of a pendant earring with a polished precious stone illuminated from within by one or two LEDs 1. The LED 1 is incorporated into the precious stone and connected electrically to the tap of an oscillatory circuit 2, which forms a rectangular spiral-shaped coil 3 with a chip or trimmer capacitor 4. The coil 3 can also be in the form of a circular spiral.

Figure 8:
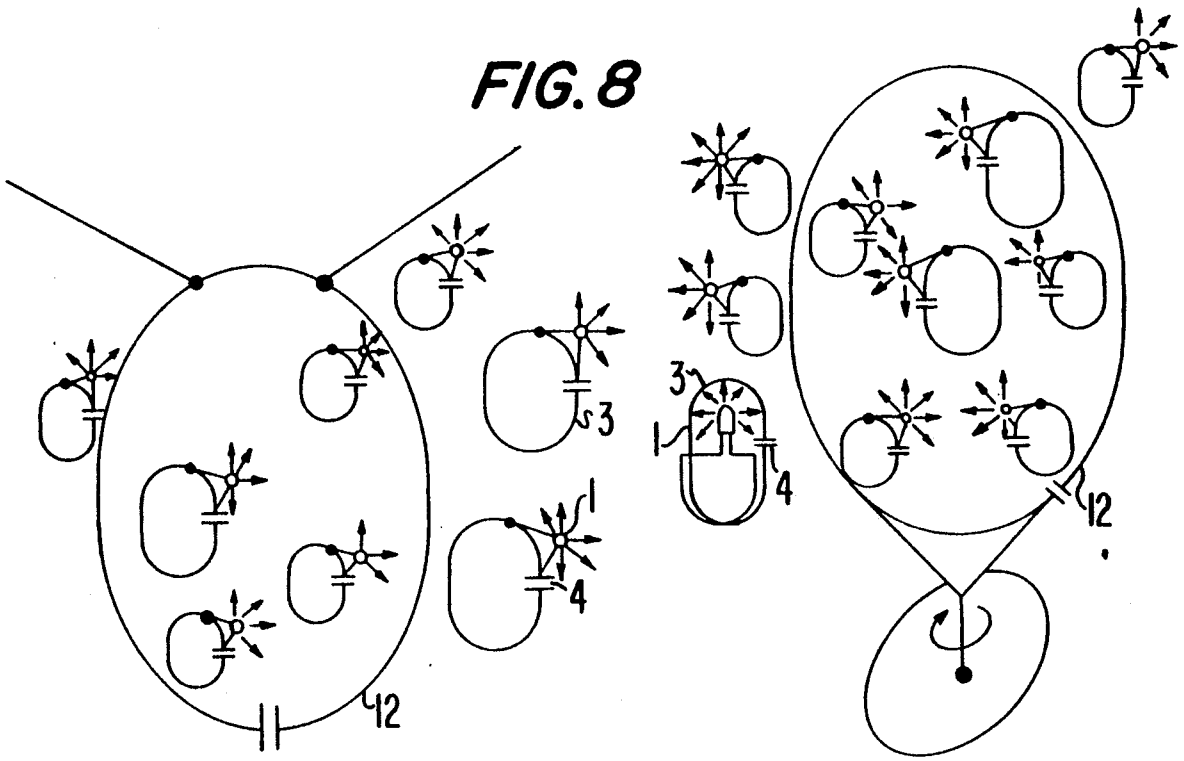
FIG. 8 shows an embodiment wherein individual oscillatory circuits with light-emitting elements are disposed in the vicinity of or directly inside a large loop of an auxiliary oscillatory circuit.

FIG. 8 shows many individual oscillatory circuits 2, each with an inductance element 3 and a capacitance element 4 and light-emitting element 1, which are disposed in the vicinity of or directly inside at least one large loop of an auxiliary oscillatory circuit 12 which is tuned to the same resonant frequency as that of the transmitter of the system.

As in FIG. 1, the LEDs 1 in FIGS. 3, 4, 5, and 7 can also be supplied from an energy source 7 consisting of a high-frequency transmitter which transmits electromagnetic waves in the 27 MHz range at a power of 200 watts from an antenna 8 in the direction of the decorative and artistic item, and supplies the light-emitting elements with zero contact with energy through the LC oscillatory circuit 2.

While we have shown and described several embodiments in accordance with the present invention, it should be clearly understood that the same is susceptible of changes and modifications without departing from the scope of the present invention. Therefore, we do not intend to be limited by the details shown and described herein but intend to cover all such changes and modifications as are encompassed by the scope of the appended claims.

We claim:

1. An illuminating system for objects such as Christmas-trees, decorations, works of art, and ornaments, comprising at least one light-emitting element operatively associated with at least one energy source without physical contact, wherein the light-emitting element is operatively directly connected to an electrical oscillatory circuit comprising an inductance element and a capacitance element connected in parallel.

2. The system according to claim 1, wherein the at least one energy source emits electromagnetic waves to the element to supply energy without physical electrical connection.

3. The system according to claim 1, wherein the at least one light-emitting element comprises a plurality of light-emitting diodes which radiate visible light of different colors.

4. The system according to claim 1 wherein the at least one light-emitting element comprises at least two LEDs being connected antiparallel to the oscillatory circuit.

5. The system according to claim 1, wherein the at least one light-emitting element is selected from a group consisting of electroluminescent elements, vacuum fluorescent elements, and plasma lights.

6. The system according to claim 1, wherein the at least one light-emitting element is a neon bulb.

7. The system according to claim 1, wherein the at least one light-emitting element is an incandescent bulb.

8. The system according to claim 1 wherein the at least one light-emitting element and the oscillatory circuit have a candle-like form.

9. The system according to claim 1 wherein the at least one light-emitting element and the oscillatory circuit are incorporated into glass balls or other glass objects.

10. The system according to claim 1, wherein the at least one light-emitting element and the oscillatory circuit are operatively associated to form decorative shapes.

11. The system according to claim 1, wherein the at least one light-emitting element is incorporated into ornamental works of art made of glass, precious stones, precious metals, plastics and the like.

12. The system according to claim 1, wherein the at least one light-emitting element is incorporated into toys, objects of daily use, textiles, or other objects.

13. The system according to claim 1 wherein the oscillatory circuit has a coil in the form of a large loop which permits the system to be used on hanging ornaments with different shapes.

14. The system according to claim 1, wherein the energy source comprises a high, constant frequency transmitter which radiates sufficient power continuously or in pulses.

15. The system according to claim 14, wherein the high-frequency transmitter includes an antenna in the form of a rod, dipole, or loop.

16. The system according to claim 15, wherein the antenna is coated with a high-frequency voltage protection agent.

17. The system according to claim 14 wherein the oscillatory circuit associated with the at least one light-emitting element is tuned to the resonant frequency of the high-frequency transmitter.

18. The system according to claim 17, wherein the at least one light-emitting element is located in the vicinity of or directly inside at least one large loop of an auxiliary oscillatory circuit which is tuned to the same resonant frequency as said high-frequency as said high-frequency transmitter.

19. The system according to claim 1, wherein the electrical oscillatory circuit includes coils and an antenna, and the antenna and the coils of the oscillatory circuit are comprised of a superconductor that operates at room temperature.

20. An illuminating system for objects such as Christmas-trees, decorations, works of art, and ornaments, comprising at least one light-emitting element operatively associated with at least one energy source without physical contact, wherein the at least one energy source emits infrared light to the element to supply energy without a physical electrical connection.

21. An illuminating system for objects such as Christmas-trees, decorations, works of art, and ornaments, comprising at least one light-emitting element operatively associated with at least one energy source without physical contact, wherein the at least one light-emitting element is operatively connected to a solar cell panel which supplies appropriate voltage and current to the light-emitting element.

22. An illuminating system for objects such as Christmas-trees, decorations, works of art, and ornaments, comprising at least one light-emitting element operatively associated with at least one energy source without physical contact, wherein the energy source comprises one of an infrared radiation source, a laser, and a group of light-emitting diodes connected in parallel or in series, which modulates the infrared light continuously, in pulses, or in modulated form.

* * * * *